United States Patent [19]

Thompson

[11] 4,064,477

[45] Dec. 20, 1977

[54] METAL FOIL RESISTOR

[75] Inventor: Edward E. Thompson, Westmont, N.J.

[73] Assignee: American Components Inc., Conshohocken, Pa.

[21] Appl. No.: 607,128

[22] Filed: Aug. 25, 1975

[51] Int. Cl.[2] ..... H01C 1/08

[52] U.S. Cl. ..... 338/51; 338/283; 338/287; 338/292; 338/293; 338/308

[58] Field of Search ..... 338/51, 275, 283, 287, 338/292, 293, 306–309, 313, 316; 29/610, 613; 219/530, 540, 543, 544, 464, 465, 345

[56] References Cited

U.S. PATENT DOCUMENTS

| | | | |
|---|---|---|---|
| 1,644,255 | 10/1927 | Kercher et al. | 219/345 |
| 2,922,866 | 1/1960 | Hicks | 219/345 X |
| 3,478,191 | 11/1969 | Johnson et al. | 219/243 X |
| 3,824,521 | 7/1974 | Horii et al. | 338/275 |

*Primary Examiner*—C. L. Albritton
*Attorney, Agent, or Firm*—William E. Cleaver

[57] ABSTRACT

The present device is a high reliability resistor comprising a sheet of metal foil secured to the flat side of a substrate and with the opposite side of the substrate formed to dissipate heat into the ambient thus enabling the present resistor to have an improved temperature coefficient of resistance (TCR) and further enabling the resistor to function satisfactorily in a high wattage mode.

6 Claims, 5 Drawing Figures

METAL FOIL RESISTOR

BACKGROUND

The metal foil type resistor was introduced as a high reliability resistor long after the wire-wound cylindrical type resistors and metal thin film cylindrical type resistors had won such recognition. The metal foil type resistor inherently has an advantage over a wire-wound resistor in that there is no inductance problem and an advantage over a thin film cylindrical resistor in that the sheet of foil is a relatively thick uniform material whose PPM resistance value is known and whose TCR value is known and which values can be relied upon. The metal foil type resistor was from its inception designed to have the metal foil sheet secured to one side (normally embedded in a layer of epoxy resin) of a substrate which had two flat sides. It was deemed important in the design of the metal foil type resistor that both sides of the substrate be formed flat and that both sides have the same thickness of epoxy resin applied thereto so that the stresses, created by the difference in the linear coefficient of expansion between the substrate and the metal foil layer, are offset by the equal mechanical constraint of the epoxy resin layers. This principle is described in the U.S. Pat. No. 3,405,381 to F. Zandman et al.

It has been found that if the substrate is selected to have a lower linear expansion coefficient than the metal foil, (in particular, if the difference in the linear coefficient of expansion between the metal and the insulating base is selected to be 26 to 66 $\times$ $10^{-7}$/° C), then the metal foil resistor can be fabricated with a molded assembly with little regard as to whether or not the epoxy resin layers on either of the substrate are of equal depth. This improvement is described in U.S. Pat. No. 3,824,521 to Horii et al. The present invention improves the TCR characteristics of the metal foil type resistor even further than the improvement just described.

SUMMARY

The present metal foil resistor in the preferred embodiment employs the improvement taught by Horii et al but would act without that improvement to provide an improved metal foil resistor as taught by Zandman et al. The present metal foil resistor comprises a sheet of metal foil secured to an electrically non-conducting substrate which has only one flat side. The sheet of metal foil is secured to said one flat side. The side of the substrate which lies opposite the flat side is formed into grooves, slots or arch shaped troughs, so that a great deal more surface of the substrate is exposed to the surrounding atmosphere. In one embodiment metal is secured to the expanded surface to enhance the heat dissipation. Accordingly as heat is generated in the metal foil in response to electrical current passing therethrough, the heat passes through the substrate and into the surrounding atmosphere at a far greater rate than is accomplished by a flat second side. The increased rate of heat dissipation effectively lowers the difference in the linear coefficient of expansion between the metal and the substrate so that less stress is generated and accordingly less change in resistance due to changes in the configuration of the metal foil. It follows then that the present metal foil resistor has an improved TCR.

The objects and features of the present invention will be better understood in view of the following description taken in conjunction with the drawings wherein.

Figure 1:
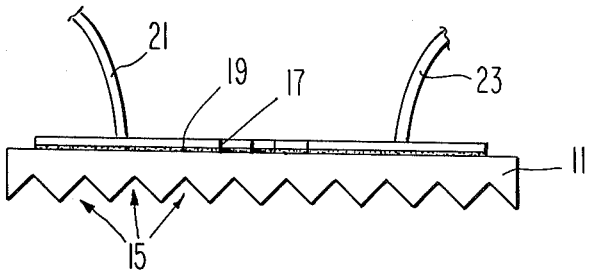
FIG. 1 shows an end view of a substrate with a sheet metal foil secured thereto.

Consider FIG. 1 which depicts a substrate 11 having a flat side 13 on top and a grooved side 15 on bottom. On the flat side 13 there is a metal foil sheet 17 bonded to the substrate 11 by a thermosetting resin 19.

Now it should be understood that in the preferred embodiment the substrate 11 is made from alumina but it could be soda glass or borosilicate glass. In the preferred embodiment the substrate could be any electrically non-conducting material which will provide a difference of linear coefficient between the metal and substrate that is in the range of 26 to 66 $\times$ $10^{-7}$/° C. Other embodiments, employing the present invention, could be fabricated with any electrically non-conducting material and the overall resistor package would have an improved TCR. For instance the use of Be0 provides excellent heat sink properties. It should be further understood that in the preferred embodiment, the metal foil is made principally of an N*i* -Cr alloy. Other alloys or metals could be used and if the Horii et al principle is to be employed the metal foil in combination with the substrate should provide a difference of linear coefficient in the range of 26 to 66 $\times$ $10^{-7}$/° C. Further it should be understood that bonding material other than thermosetting resin can be employed.

In FIG. 1 there are shown the terminal wires 21 and 23 connected to the metal foil sheet 17. The arrangement of the terminal wires 21 and 23 can be better appreciated from an examination of FIG. 2.

Figure 2:
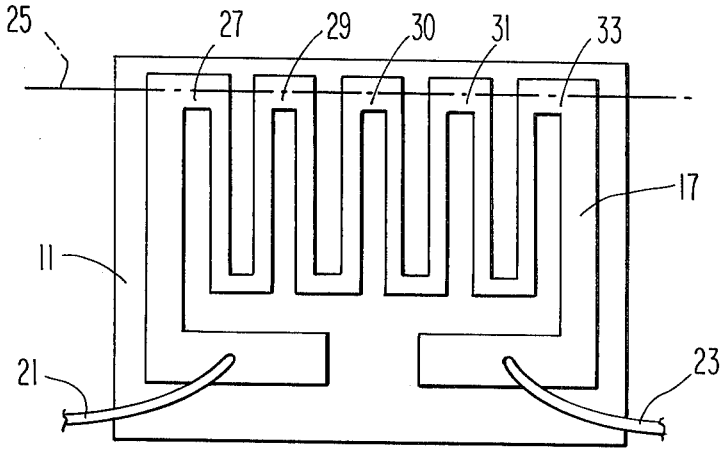
FIG. 2 shows a top view of the metal foil resistor.

In FIG. 2 we find that the metal foil 17 is laid out in a zig-zag path so that if it is trimmed off, for instance along the side of the path or along the top sections of the path, the resistance will increase. By way of example, if the foil were trimmed along the dash-dot line 25, the resistance at sections 27, 29, 31, 33, etc. would be increased. This feature enables the metal foil resistor to be fabricated in a general way and then trimmed to precisely the correct resistance value.

When an electrical circuit or electrical power source is connected to line 21, electrical current passes along the foil 17 to the terminal wire 23 and on to the remainder of the circuit. The current passing therethrough and encountering the resistance of the foil gives rise to the generation of heat ($I^2$ R or watts). The heat tends to expand the foil 17 in accordance with its expansion coefficient and tends to expand the substrate in accordance with its expansion coefficient. If the expansion coefficients differ significantly stresses will result, particularly on the foil, and this will change the shape of the foil or shape of the current path. When the shape of the path changes the resistance changes. If the resistance change is large, i.e., $\pm$ 0.1% or greater then the resistor is normally not considered a stable hi-rel (high reliability) resistor.

The present resistor operates to dissipate the generated heat more rapidly than the prior art flat surface arrangement so that the stresses are held to a minimum. Accordingly, the resistance changes are in the order of $\pm$0.01% or less and the present resistor is considered a stable hi-rel resistor. The heat dissipation can be further enhanced if beryllium oxide is used as the substrate.

Figure 3:
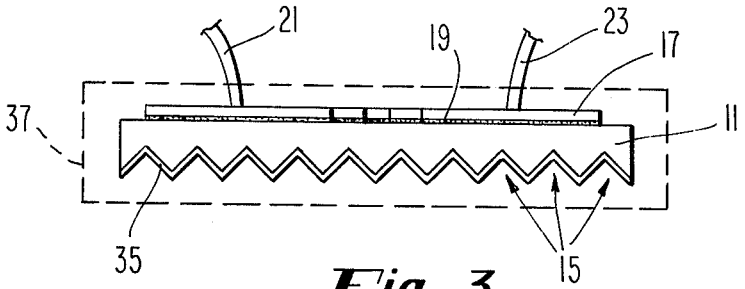
FIG. 3 depicts an end view of a metal foil resistor shown in FIG. 1 but with metal secured to the grooved side and with a molded encasement show in phantom.

FIG. 3 depicts the device of FIG. 1 but with a layer of metal 35 secured to the grooves 15. The metal 35 in the preferred embodiment is nickel, but it should be understood that it can be aluminum or Nickel-Chromium, or any metal which radiates heat to its surroundings. If the Horii principle is employed along with the present invention, there is very little stress created and hence the resistor can be encapsulated in a molded encasement 37 without the requisite that the upper and lower layers of the epoxy mold be the same thickness.

Figure 4A:
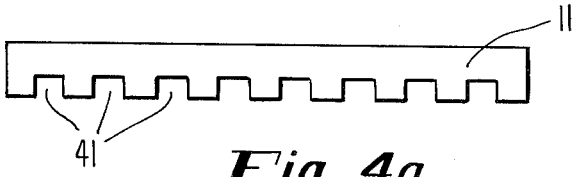
FIGS. 4*a* and 4*b* show other forms of the under surface.
Figure 4B:
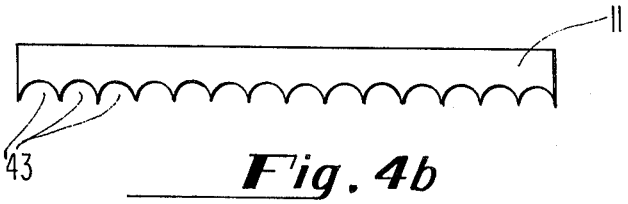

FIG. 4*a* shows the substrate 11 with rectangular slots 41 cut along the bottom side. FIG. 4*b* shows the substrate 11 with arch shaped troughs 43 formed along the bottom side. It should be understood that metal material secured to the expanded surfaces of the substrates of FIGS. 4*a* and 4*b* would enhance the heat dissipation but such shapes improve the heat dissipation without the metal.

What is claimed is:

1. A metal foil resistor comprising in combination: a substrate of electrically non-conducting material having first and second relatively large surfaces, said first surface formed substantially flat, said second surface formed with grooves to cause the surface area of said second surface to be substantially in excess of said first surface; a layer of electrically conducting metal foil secured to said first surface, said layer of metal formed in a zig-zag pattern to provide an elongated path for electricity passing therethrough; first and second electrical wires secured to two different positions on said layer of electrically conducting metal foil; and encapsulating means formed to embed said substrate and said metal foil within and further formed to permit said electrical wires to protrude therefrom.

2. A metal foil resistor according to claim 1 wherein said grooves are V-shaped grooves.

3. A metal foil resistor according to claim 1 wherein said grooves are arch-shaped.

4. A metal foil resistor according to claim 1 wherein said grooves are rectangular-shaped.

5. A metal foil resistor according to claim 1 wherein said substrate is formed of beryllium oxide.

6. A metal foil resistor comprising in combination: a substrate of electrically non-conducting material having first and second relatively large surfaces, said first surface formed substantially flat, said second surface formed with grooves to cause the surface area of said second surface to be substantially in excess of said first surface; a layer of metal means formed and secured to the surfaces of said grooves; a layer of electrically conducting metal foil secured to said first surface, said layer of metal foil formed in a zig-zag pattern to provide an elongated path for electricity passing therethrough; first and second electrical wires secured to two different positions on said layer of electrically conducting metal foil; and encapsulating means formed to embed said substrate and said metal foil within and further formed to permit said electrical wires to protrude therefrom.

* * * * *